US008003871B2

(12) United States Patent
Kitajima

(10) Patent No.: US 8,003,871 B2
(45) Date of Patent: Aug. 23, 2011

(54) KEYBOARD APPARATUS

(75) Inventor: Mitsuru Kitajima, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/562,972

(22) Filed: Sep. 18, 2009

(65) Prior Publication Data

US 2010/0071531 A1 Mar. 25, 2010

(30) Foreign Application Priority Data

Sep. 25, 2008 (JP) ..... 2008-245796

(51) Int. Cl.
*G10C 3/12* (2006.01)

(52) U.S. Cl. ..... 84/423 R; 84/439

(58) Field of Classification Search ..... 84/423 R, 84/439

See application file for complete search history.

(56) References Cited

U.S. PATENT DOCUMENTS

| | | | | |
|---|---|---|---|---|
| 4,993,305 | A * | 2/1991 | Franz et al. | 84/439 |
| 5,243,125 | A * | 9/1993 | Yamaguchi | 84/745 |
| 5,249,497 | A * | 10/1993 | Niitsuma | 84/247 |
| 5,574,241 | A * | 11/1996 | Kumano et al. | 84/439 |
| 5,610,352 | A * | 3/1997 | Yamaguchi | 84/435 |
| 5,696,340 | A * | 12/1997 | Ragni | 84/423 R |
| 5,821,443 | A | 10/1998 | Masubushi | |
| 6,147,290 | A * | 11/2000 | Uno | 84/433 |
| 7,208,668 | B2 * | 4/2007 | Shimoda | 84/434 |
| 7,485,798 | B2 * | 2/2009 | Nishida | 84/644 |
| 7,541,532 | B2 * | 6/2009 | Osuga et al. | 84/436 |
| 7,586,030 | B2 * | 9/2009 | Nishida | 84/423 R |
| 7,692,089 | B2 * | 4/2010 | Nishida | 84/644 |
| 7,709,718 | B2 * | 5/2010 | Osuga | 84/423 R |
| 7,750,222 | B2 * | 7/2010 | Osuga | 84/423 R |
| 7,816,598 | B2 * | 10/2010 | Ishihara et al. | 84/423 R |
| 2004/0261598 | A1 | 12/2004 | Uno et al. | |
| 2007/0017338 | A1 | 1/2007 | Nishida | |

(Continued)

FOREIGN PATENT DOCUMENTS

| | | | |
|---|---|---|---|
| CN | 1901029 | A | 1/2007 |

(Continued)

OTHER PUBLICATIONS

European Search Report mailed Nov. 11, 2010, for EP Patent Application No. 09170510.3, five pages.

*Primary Examiner* — Jeffrey Donels
*Assistant Examiner* — Robert W Horn
(74) *Attorney, Agent, or Firm* — Morrison & Foerster LLP

(57) ABSTRACT

A keyboard apparatus made longitudinally compact while ensuring a pivotal motion range of hammers within a limited space. Common base ends, to which main bodies of white and black keys are connected via vertically extending hinges, are stacked one upon another and fastened to a fastening part of a frame. Hammers are each supported on a hammer pivot shaft such that its rear end is moved upward about the pivot shaft in a key-depression forward stroke. The hammers have their rear ends located forward of rearmost positions of visible parts of black keys. The hammer pivot shafts are located rearward of frontmost positions of the visible parts. A plate portion of the frame, on which key switches are disposed, is located forward of the rearmost positions of the visible parts of the black keys and upward of the fastening part of the frame.

12 Claims, 3 Drawing Sheets

U.S. PATENT DOCUMENTS

| | | | | |
|---|---|---|---|---|
| 2008/0017016 | A1 | 1/2008 | Toyama | |
| 2010/0000394 | A1* | 1/2010 | Komatsu | 84/439 |
| 2010/0071531 | A1* | 3/2010 | Kitajima | 84/423 R |
| 2010/0071532 | A1* | 3/2010 | Kitajima et al. | 84/432 |
| 2010/0071534 | A1* | 3/2010 | Kitajima et al. | 84/439 |
| 2011/0005370 | A1* | 1/2011 | Kitajima | 84/744 |

FOREIGN PATENT DOCUMENTS

| | | | |
|---|---|---|---|
| EP | 1 881 481 | A1 | 1/2008 |
| JP | 9269783 | | 10/1997 |
| JP | 11175054 | | 7/1999 |
| JP | 2008-026403 | A | 2/2008 |
| JP | 20008-26403 | | 2/2008 |

* cited by examiner

KEYBOARD APPARATUS

BACKGROUND OF THE INVENTION

1. Field of the Invention

The present invention relates to a keyboard apparatus having a frame integrally formed by resin and pivotably supporting a plurality of keys, and more particularly, to a keyboard apparatus having hammers supported on a frame so as to each pivot in conjunction with a corresponding key and impart inertia to the key.

2. Description of the Related Art

Conventionally, keyboard apparatuses have been known in which a frame integrally formed by resin and pivotably supporting a plurality of keys is adapted to be supported on a musical instrument main body. Among these, some keyboard apparatus includes hammers supported on the frame and each adapted to pivot in conjunction with a corresponding key and impart inertia to a pivotal motion of the key (Japanese Patent Publication No. 3819136 and Japanese Laid-open Patent Publication No. 9-269783).

In the keyboard apparatuses in Japanese Patent Publication No. 3819136 and Japanese Laid-open Patent Publication No. 9-269783, the hammers are disposed below the keys and each driven by a corresponding key so as to pivot about a hammer support.

These keyboard apparatuses are provided with key-depression sensors for detecting key-depression operations, each sensor being disposed below a corresponding hammer so as to be depressed by the hammer.

The keyboard apparatuses are further provided with initial and end stoppers adapted for contact with the hammers to restrict initial and end positions of pivotal motions of the hammers. Since these stoppers are disposed in a longitudinal direction on the same side with respect to the hammer supports, initial and end stopper-formed portions of the frame must be somewhat differentiated in longitudinal position from each other for ease of die molding of the frame. As a result, the frame becomes long in longitudinal length.

In deed, rear ends of the hammers in Japanese Patent Publication No. 3819136 are more projected rearward than rear ends of the keys, and front ends of the hammers in Japanese Laid-open Patent Publication No. 9-269783 are more projected forward than front ends of the keys. As a result, the key board apparatuses are long in longitudinal length.

Furthermore, since the key-depression sensors are each disposed below the corresponding hammer so as to be depressed by the hammer, a pivotal motion range of the hammers is limited. To attain a sufficient pivotal motion range, the keyboard apparatuses tend to be large in vertical size.

Incidentally, it has been known to configure keys to have key main bodies connected via thin-plate-like hinges to base ends of the keys and arrange the base ends to vertically extend so as to reduce the longitudinal length of keyboard apparatus (Japanese Laid-open Patent Publication No. 2008-26403).

In this keyboard apparatus, however, a suitable construction for keyboard apparatus provided with hammers was not adequately considered, and there is a scope for studying how the keyboard apparatus having hammers can be much more compact in its entirety.

SUMMARY OF THE INVENTION

The present invention provides a keyboard apparatus capable of being longitudinally compact while ensuring a pivotal motion range of hammers within a limited space.

According to a first aspect of the present invention, there is provided a keyboard apparatus, which comprises a frame having a plurality of hammer supports and integrally formed by resin, the frame being adapted to be supported on a musical instrument main body, a plurality of white and black keys mutually juxtaposed on the frame and forming one key unit by having key main bodies thereof each connected to its base end via a thin plate-like hinge, each of the key main bodies being pivotable about the base end as a key fulcrum in key depression and release directions, a plurality of hammers mutually juxtaposed so as to correspond to respective ones of the keys and supported by the hammer supports of the frame at locations below respective ones of the keys so as to each pivot about a corresponding one of the hammer supports in conjunction with the corresponding key and impart inertia to a pivotal motion of the key, each of the hammers being driven at its front half located forward of the hammer support such that a rear end portion of the hammer is moved upward in a key-depression forward stroke, detection devices each adapted to be depressed by a corresponding one of the keys and detect an operation of the key, and detection-device mounting portions integrally formed on the frame and respectively mounted with the detection devices, wherein the plurality of keys are mounted to the frame by being fastened to a fastening part of the frame by a fastener, with the base ends of the keys stacked one upon another, the hinges of the keys are formed to extend in a direction to cross key depression surfaces of the key main bodies and parallel to a key arrangement direction, the hammers have their rear ends located forward of rearmost positions of visible parts of the black keys, the visible parts being visible during performance, the hammer supports are located rearward of frontmost positions of the visible parts of the black keys, and the detection-device mounting portions are located forward of the rearmost positions of the visible parts of the black keys and upward of the fastening part of the frame.

According to a second aspect of the present invention, there is provided a keyboard apparatus, which comprises a frame having hammer supports and integrally formed by resin, the frame being adapted to be supported on a musical instrument main body, a plurality of white and black keys mutually juxtaposed on the frame and having key main bodies thereof each connected to its base end via a thin plate-like hinge for pivotal motion about the base end as a key fulcrum in key depression and release directions, a plurality of hammers mutually juxtaposed so as to correspond to respective ones of the keys and supported by the hammer supports of the frame at locations below respective ones of the keys so as to each pivot about a corresponding one of the hammer supports in conjunction with the corresponding key and impart inertia to a pivotal motion of the key, each of the hammers being driven at its front half located forward of the hammer support such that a rear end portion of the hammer is moved upward in a key-depression forward stroke, an initial stopper disposed forward of the hammer supports and formed on the frame integrally therewith or separately therefrom, the initial stopper being adapted for contact with the front halves of the hammers to thereby restrict initial pivot positions of the hammers corresponding to key-depression initial positions, and an end stopper disposed rearward of the hammer supports and formed on the frame integrally therewith or separately therefrom, the end stopper being adapted for contact with the rear end portions of the hammers to thereby restrict pivot end positions of the hammers corresponding to key-depression end positions, wherein the plurality of keys are mounted to the frame by being fastened to a fastening part of the frame by a fastener, with the base ends of the keys stacked one upon another, the hinges are formed to extend in a direction to cross key depression surfaces of the key main bodies and parallel to a key arrangement direction, the hammers have their rear ends located forward of rearmost positions of visible parts of the black keys, the visible parts being visible during performance, and the hammer supports are located rearward of frontmost positions of the visible parts of the black keys.

With this invention, it is possible to make the longitudinal size of the keyboard apparatus compact, while ensuring a pivotal motion range of hammers within a limited space.

The detection devices can have their lowermost parts positioned in a vertical direction between the fastening part of the frame and connection parts where the key main bodies of the keys are connected with the hinges.

In this case, a space below the detection devices can be increased, making it easy to ensure a pivotal motion range of the hammers.

The detection devices can have their lowermost parts positioned upward of connection parts where the base ends of the keys are connected with the hinges.

Also in this case, a space below the detection devices can be increased, making it easy to ensure a pivotal motion range of the hammers.

The detection devices can have their lowermost parts positioned in a vertical direction between connection parts where the key main bodies of the keys are connected with the hinges and connection parts where the base ends of the keys are connected with the hinges.

Also in this case, a space below the detection devices can be increased, making it easy to ensure a pivotal motion range of the hammers.

The keyboard apparatus can include an end stopper disposed rearward of the hammer supports and formed on the frame integrally therewith or separately therefrom, the end stopper being adapted for contact with rear halves of the hammers to thereby restrict pivot end positions of the hammers corresponding to key-depression end positions, and an end-stopper mounting portion integrally formed on the frame and mounted with the end stopper, and the end-stopper mounting portion can be disposed in a vertical direction between the fastening part of the frame and connection parts where the key main bodies of the keys are connected with the hinges.

In this case, a pivotal motion range of the hammers can be ensured, and the height size of the frame can be suppressed while ensuring an appropriate thickness of the end stopper.

The end-stopper mounting portion can be disposed at substantially a same height position as that of connection parts where the base ends of the keys are connected with the hinges.

Also in this case, a pivotal motion range of the hammers can be ensured, and the height size of the frame can be suppressed while ensuring an appropriate thickness of the end stopper.

The end-stopper mounting portion can be positioned below the detection devices.

In this case, the detection devices and the end-stopper mounting portion can concentratedly be disposed to thereby enhance the component arrangement efficiency and make the keyboard apparatus compact.

Lowermost positions of the keys can be located below uppermost positions of the rear end portions of the hammers which are at pivot end positions.

In this case, the base ends of the keys can be designed to extend vertically, whereby the entire length of each key can be shortened to thereby make the keyboard apparatus longitudinally compact.

The keyboard apparatus can include a plurality of frame function parts formed on the frame integrally therewith or separately therefrom, each of the frame function parts being adapted for contact and engagement with a corresponding one of constituent elements of the keyboard apparatus other than the frame when the keyboard apparatus is in use, and a plurality of function-part mounting portions integrally formed on the frame and respectively mounted with the frame function parts, each of the function-part mounting portions being adapted to receive an external force via a corresponding one of the frame function parts, and plural ones among the function-part mounting portions can be disposed in a vertical direction between the fastening part of the frame and connection parts where the key main bodies of the keys are connected with the hinges.

In this case, the function-part mounting portions can concentratedly be disposed at an upper part of the frame, whereby a pivotal motion range of the hammers can be ensured and the height size of the frame can be suppressed.

The frame function parts can include the hammer supports and a contact portion, the contact portion being integrally formed on the frame and adapted to be in contact with the musical instrument main body to thereby support the frame on the musical instrument main body, and all the frame function parts except the contact portion and the hammer supports can be disposed upward of lowermost positions of the base ends of the keys.

In this case, all the frame function parts except the contact portion and the hammer supports can concentratedly be disposed at an upper part of the frame, whereby a pivotal motion range of the hammers can be ensured and the height size of the frame can be suppressed.

Further features of the present invention will become apparent from the following description of an exemplary embodiment with reference to the attached drawings.

DETAILED DESCRIPTION OF THE PREFERRED EMBODIMENT

The present invention will now be described in detail below with reference to the drawings showing a preferred embodiment thereof.

Figure 1:
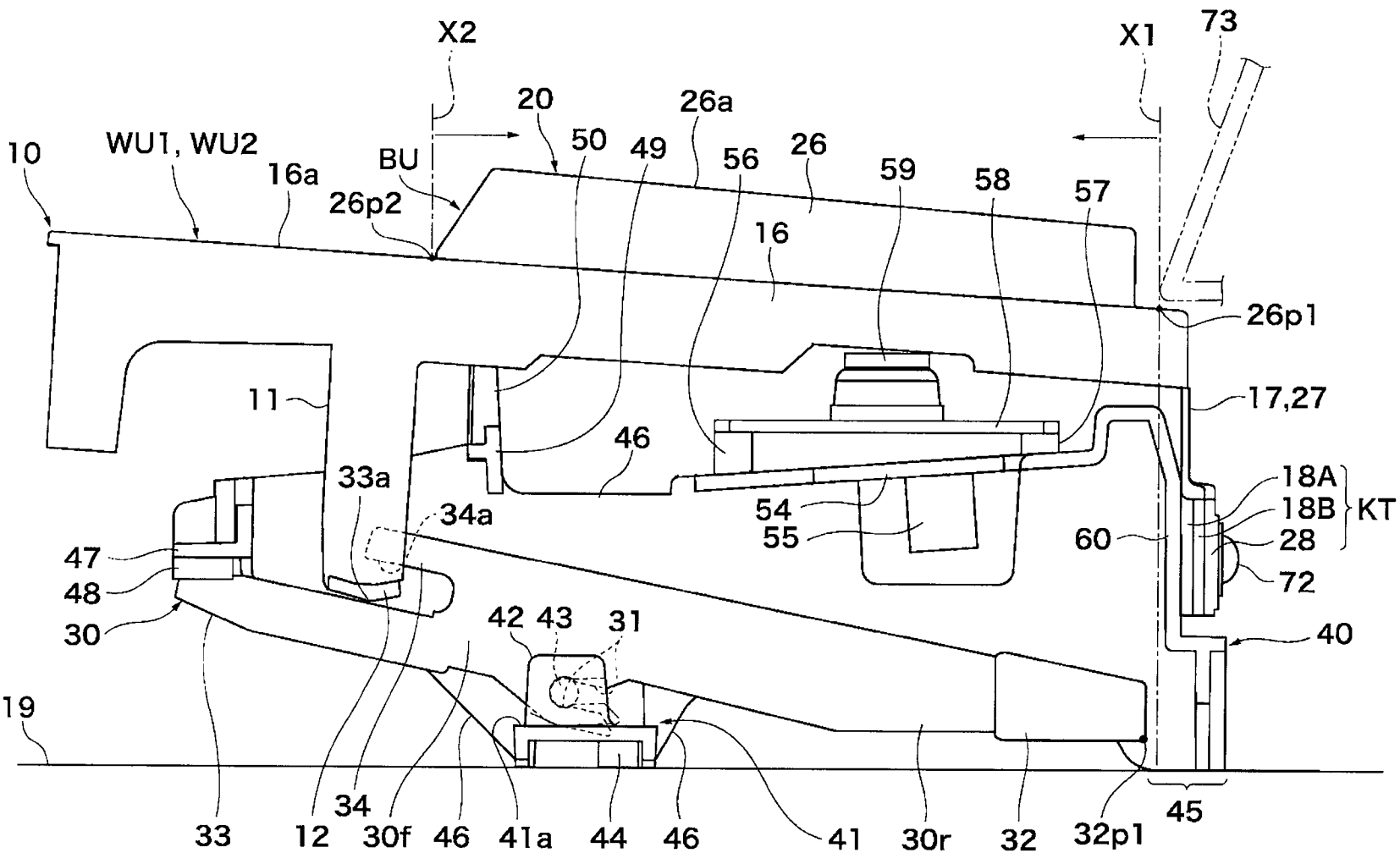
FIG. 1 is a side view showing the internal construction of a keyboard apparatus according to one embodiment of this invention.
Figure 2:
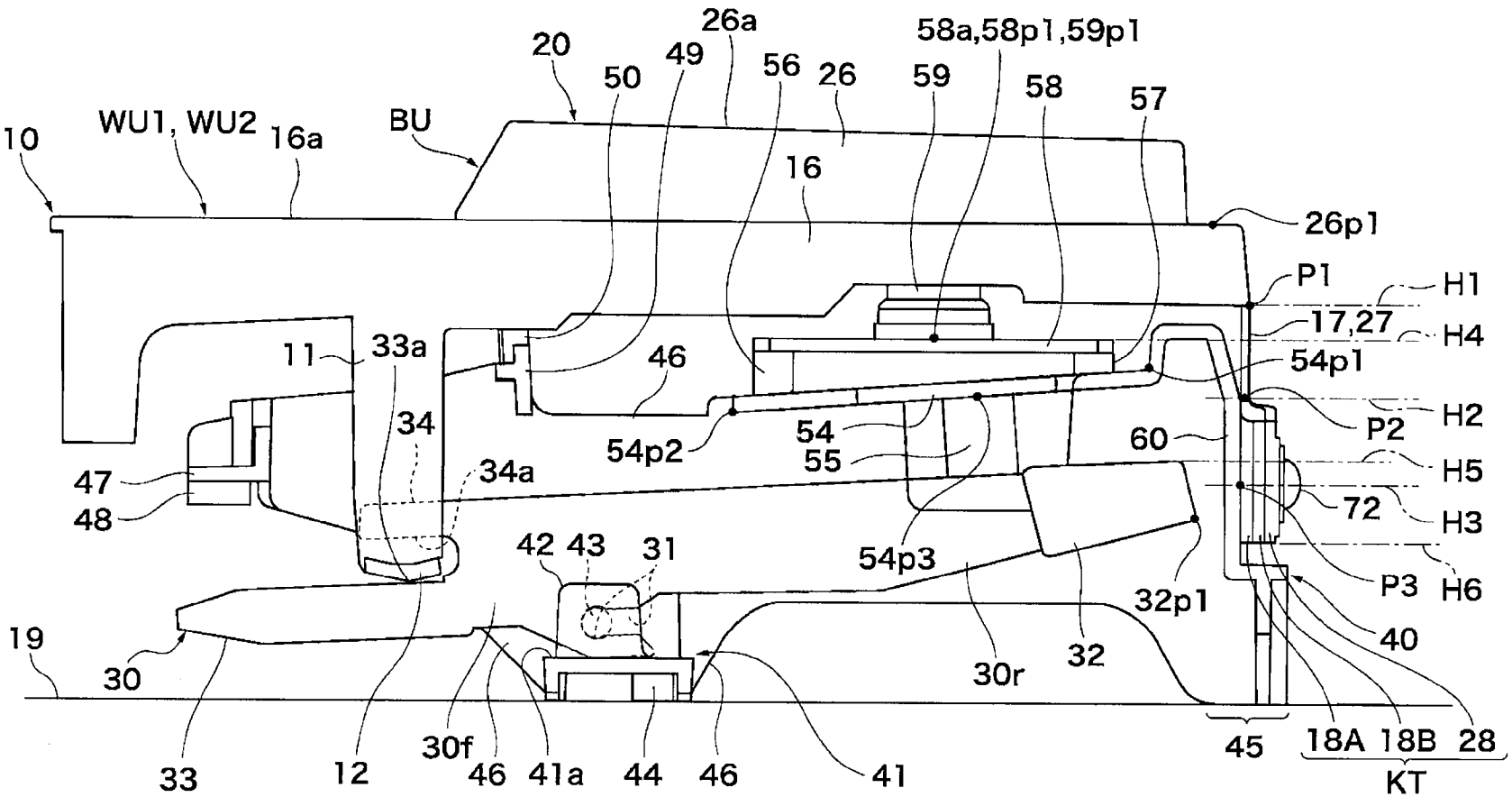
FIG. 2 is a side view showing the keyboard apparatus in a state where a key is depressed.

FIGS. 1 and 2 show in side view the internal construction of a keyboard apparatus according to one embodiment of this invention. The keyboard apparatus is for use in, for example, an electronic keyboard instrument, and has a frame 40 which is integrally formed by resin and on which white keys 10, black keys 20, and hammers 30 are mounted. White and black keys 10, 20 are shown in an initial non-depressed state in FIG. 1 and in a depressed state in FIG. 2.

In the following, a side of the keyboard apparatus toward a player and an opposite side thereof (the left and right sides in FIG. 1) will be respectively referred to as the front and rear sides of the apparatus, and the left-to-right direction will be determined in reference to the player.

The white and black keys 10, 20 are mutually juxtaposed in the left-to-right direction (which is also referred to as the key arrangement direction), and the hammers 30 are mutually juxtaposed in the key arrangement direction. The hammers 30 are provided so as to correspond to respective ones of the keys, and are each disposed below the corresponding key to impart inertia to a pivotal motion of the key.

As with an arrangement in Japanese Laid-open Patent Publication No. 2008-26403, plural white keys 10 and plural black keys 20 are integrally formed into a key unit. For example, the key unit is constructed, e.g., on an octave basis, in which two white key units WU1, WU2 and a black key unit BU are assembled in a stacked relation. Each of these units WU1, WU2, BU is integrally formed by resin. The number of keys in one key unit is not limited to that for one octave.

The black key unit BU includes black keys 20 having black key main bodies 26 respectively corresponding to tone pitches C#, D#, F#, G#, and A#. The white key unit WU1 includes white keys 10 having white key main bodies 16 respectively corresponding to tone pitches C, E, G, and B, and the white key unit WU2 includes white keys 10 having white key main bodies 16 respectively corresponding to tone pitches D, F, and A. The white key main bodies 16 and the black key main bodies 26 have upper surfaces respectively functioning as key depression surfaces 16*a*, 26*a*.

The black key unit BU includes thin plate-like hinges 27 extending downwardly from rear ends of the black key main bodies 26 and having lower ends thereof connected to a common-to-black-keys base end 28. The common base end 28 extends vertically and has a width corresponding to one octave as viewed in the key arrangement direction. The black key main bodies 26 are pivotable in the vertical direction (in key depression and release directions) via the hinges 27 about the common-to-black-keys base end 28 as a key fulcrum.

As with the black key unit BU, the white key units WU2 each include hinges 17 extending downwardly from rear ends of the white key main bodies 16 and having lower ends thereof connected to a common-to-white-keys base end 18A or 18B. Each white key main body 16 is vertically pivotable via the corresponding hinge 17 about the common-to-white-keys base end 18A or 18B as a key fulcrum. The hinges 17, 27 and the common base ends 18A, 18B, 28 extend in the vertical direction perpendicularly to the key depression surfaces 16*a*, 26*a* and in parallel to the key arrangement direction.

When the white key units WU1, WU2 and the black key unit BU are assembled into the key unit, the common-to-white-keys base ends 18A, 18B and the common-to-black-keys base end 28 are stacked one upon another in this order as seen from front. The common base ends 18A, 18B, 28 stacked in contact with one another constitute a common-to-all-keys base end KT.

The keyboard apparatus is provided with a panel 73 that covers upper rear parts of the white and black key main bodies 16, 26. A part of each black key 20 which is located forward of the panel 73 includes a part always hidden by an adjacent white key 10 and the other part visible from the player during performance. Hereinafter, the part visible from the player will be referred to as the visible part. Specifically, the visible part of each black key 20 is a part of the black key main body 26 that longitudinally extends between vertical planes X1 and X2 in FIG. 1. Frontmost and rearmost positions of the visible part are denoted by reference numerals 26*p*1 and 26*p*2, respectively. It should be noted that the rearmost position 26*p*2 represents a position assumed by the rearmost end of the visible part of the corresponding black key 20 which is at its key-depression end position.

The hammers 30 are supported on hammer pivot shafts 43 of the frame 40 so as to be vertically pivotable about the pivot shafts 43 (so that front and rear ends of each hammer 30 are pivotable upward and downward about the pivot shaft 43). Each white key 10 is formed at its front part with a pendent piece 11 extending downward. The pendent piece 11 has its lower end that constitutes a hammer driving portion 12 having a damper member. This also applies to the black keys 20.

Each hammer 30, which is formed into a rod shape, has its engagement recess 31 into which the hammer pivot shaft 43 is engaged, and front and rear extensions 30*f*, 30*r* thereof respectively extending forward and rearward with respect to the engagement recess 31. The engagement recess 31 is opened rearwardly. At a rear end of the rear extension 30*r*, there is provided a mass portion 32 where most of the mass of the hammer 30 is concentrated. The front extension 30*f* is formed with a crab claw-like engagement portion having a long lower engagement portion 33 and a short upper engagement portion 34.

The lower and upper engagement portions 33, 34 of each hammer 30 are always in engagement with the hammer driving portion 12 of the corresponding white or black key 10 or 20, so that the hammer 30 is pivoted in forward and reverse directions in conjunction with the key. Although a detailed illustration is omitted, the hammer driving portion 12 is formed with an arcuate portion, as seen from side, not only on a lower side but also on an upper side thereof. The hammer driving portion 12 is slidably held between the lower and upper engagement portions 33, 34, whereby each hammer 30 is smoothly operable in both the key depression direction and the key release direction without rattle relative to the corresponding key 10 or 20. The lower and upper engagement portions 33, 34 respectively have a driven part 33*a* and a contact engagement portion 34*a*, which are in direct contact engagement with the hammer driving portion 12.

The frame 40 is integrally formed by injection molding and fixedly disposed on a keybed 19. The keybed 19, without regard to its designation, can be any part of the musical instrument main body such as a bottom plate of a lower casing of the instrument.

The frame 40 has a stopper mounting portion 47 formed at its frontmost part, and a key-guide coupling portion 49 formed rearward and upward of the stopper mounting portion 47. At a lowermost part of the frame 40, a front-side supporting portion 41 is formed slightly rearward of the key-guide coupling portion 49. At a lowermost rear part of the frame 40, there is formed a rear-side supporting portion 45. The front-side and rear-side supporting portions 41, 45 have their lower ends which are in direct contact with the keybed 19. The frame 40 is supported on the keybed 19 only at two places, i.e., the front-side and rear-side supporting portions 41, 45. In other words, the supporting portions 41, 45 serve as contact portions adapted to be in contact with the keybed 19 to support the frame 40 on the keybed 19.

Further, the frame 40 has a rear wall 60 thereof extending vertically upwardly from a rear end of the rear-side supporting portion 45, forwardly bent to form a horizontal step, and then again extending vertically upwardly, a bent portion thereof extending from an upper end of the rear wall 60 and formed into an inverted U-shape in cross section, and a plate portion 54 thereof extending forwardly and slightly downwardly from the bent portion. The rear wall 60, the bent portion, and the plate portion 54 are formed integrally together. The plate portion 54 extends up to a longitudinally intermediate portion of the frame 40, which is located upward and rearward of the front-side supporting portion 41.

The stopper mounting portion 47, the key-guide coupling portion 49, the front-side supporting portion 41, the key-support coupling portion 51, and the plate portion 54 are integrally formed over the entire width of the frame 40 as viewed in the key arrangement direction. These frame portions are integrally connected with the rear-side supporting portion 45 and the rear wall 60 by means of vertical ribs 46. The vertical ribs 46 are provided, one for plural keys. For example, two or three vertical ribs 46 are provided per octave, but this is not limitative.

On a lower surface of the stopper mounting portion 47, there is mounted an initial stopper 48 with which the lower engagement portions 33 of the hammers 30 are brought in contact and which restricts initial pivot positions of the hammers 30 in a key-depression forward stroke. In a non-key-depression state, due to the weights of the mass portions 32 acting to move the rear extensions 30*r* of the hammers 30 downward, the lower engagement portions 33 of the hammers 30 are in contact at their upper surfaces 33*b* with a lower surface 48*a* of the initial stopper 48, whereby the initial pivot positions of the hammers 30 are restricted. Since the lower engagement portions 33 of the hammers 30 are always in engagement with the hammer driving portions 12 of the white and black keys 10, 20, non-key-depression positions, i.e., key-depression initial positions of the white and black keys 10, 20 are indirectly restricted when the initial pivot positions of the hammers 30 are restricted.

At a mounting part 54*p*3 (see FIG. 2) near the longitudinal center of the lower surface of the plate portion 54, there is mounted an end stopper 55 with which the rear extensions 30*r* of the hammers 30 are brought in contact, whereby pivot end positions of the hammers 30 are restricted. When any of the keys 10, 20 is depressed, the hammer driving portion 12 of the depressed key drives the driven part 33*a* of the lower engagement portion 33 of the corresponding hammer 30, whereby the hammer 30 is pivoted counterclockwise in FIG. 1. Then, the rear extension 30*r* of the hammer 30 is brought in contact with the end stopper 55, thereby restricting the pivot end position, i.e., the key-depression end position of the depressed key 10 or 20 and that of the corresponding hammer 30 in the key-depression forward stroke. When the key-depression is released from the key-depression end state, a reverse stroke starts. Specifically, the hammer 30 is pivoted clockwise due to the weight of its mass portion 32 and restored to its initial position. At that time, the driven part 33*a* of the hammer 30 drives the hammer driving portion 12 of the released key 10 or 20, whereby the released key is returned to its initial position.

The initial stopper 48 and the end stopper 55 are each formed by a material having a damping function such as felt, and extend over the entire width of the frame 40 in the key arrangement direction. Alternatively, the stoppers 48, 55 can be provided, one for each hammer 30. It should be noted that the initial and end stoppers 48, 55 can be made of a soft material such as elastomer and can be formed integrally with the frame 40 by two-color molding. On an upper surface of the plate portion 54, there are integrally formed a plurality of base-plate mounting portions 56, 57 on which base plates 58 are fixed.

At mounting parts 58*p*1 (see FIG. 2) near the longitudinal centers of upper faces 58*a* of the base plates 58, there are disposed key switches 59 respectively corresponding to the keys. Since the upper face 58*a* of the base plate 58 extends horizontally, a lower face of each key switch 59 constitutes a lowermost part 59*p*1 of the switch 59. The key switches 59 are each adapted to be depressed by the corresponding key 10 or 20 to detect the depression of the key. The musical instrument main body is provided with a musical tone generator (not shown) by which musical tones are generated based on a result of detection by the key switches 59.

Key guides 50 extend upward from the key-guide coupling portion 49 and are formed integrally therewith. The key guides 50 are provided to respectively correspond to the keys and each adapted to guide a pivotal motion of the corresponding key. Alternatively, the key guides 50 can be fabricated separately from the frame 40 and then fixed thereto. On an upper surface 41*a* of the front-side supporting portion 41, there are formed pairs of projections 42, each pair for one hammer 30. Each hammer pivot shaft 43 is formed between the corresponding pair of projections 42.

A plurality of bosses 44 are formed on the front-side supporting portion 41 integrally therewith. Although an illustration is omitted, a plurality of bosses are integrally formed also on the rear-side supporting portion 45. By using screws threadedly engaging screw holes (not shown) formed in the bosses of the front-side and rear-side supporting portions 41, 45, the frame 40 is fixed to the keybed 19 constituting a part of the musical instrument main body.

When the keyboard apparatus is in use, the initial stopper 48, the key guides 50, the hammer pivot shafts 43, the key supports 53, the key switches 59, and the end stopper 55 are not in contact or engagement with the frame 40 but are each in contact or engagement with other constituent element of the keyboard apparatus. They serve as constituent elements that help the frame 40 function as a key frame for appropriately supporting the keys 10, 20 and a hammer frame for appropriately supporting the hammers 30. Hereinafter, these constituent elements will be referred to as the frame function parts. The front-side and rear-side supporting portions 41 and 45 each have a function of being in direct contact with and being fixed to the keybed 19 also serve as frame function parts.

On the other hand, the key-guide coupling portion 49 is mounted with the key guides 50, and the stopper mounting portion 47 is mounted with the initial stopper 48. The plate portion 54 is mounted with the end stopper 55, and mounted with the base plates 58 and the key switches 59 via the base plate mounting portions 56, 57, and the front-side supporting portion 41 is integrally formed with the hammer pivot shafts 43. Thus, the key-guide coupling portion 49, the stopper mounting portion 47, the plate portion 54, and the front-side supporting portion 41 will be referred to as the function-part mounting parts. Each of the function-part mounting parts can be defined as a part which is integrally formed on the frame 40, is mounted with a frame function part, and receives an external force via the frame function part.

The above-described key unit is integrally assembled beforehand, and then mounted at its common-to-all-keys base end KT to the frame 40. Specifically, the common-to-all-keys base end KT is fastened to the rear wall 60 of the frame 40 by a screw 72 from rear.

When assembled to the frame 40, each hammer 30 is inserted into the frame 40 from front, with its longitudinal axis made parallel to the longitudinal direction of the frame 40. Since the engagement recess 31 of the hammer 30 is opened rearwardly, the engagement recess 31 is naturally fitted onto the hammer pivot shaft 43 when the hammer 30 is moved rearward while its longitudinal axis is kept parallel to the longitudinal direction of the frame 40.

In FIG. 2, connection parts where the white and black key main bodies 16, 26 are respectively connected with the hinges 17, 27 are each denoted by P1, and connection parts where the hinges 17, 27 are respectively connected with the common base ends 18A, 18B, 28 are each denoted by P2. A part of the rear wall 60 with which the common-to-all-keys base end KT is in contact and through which the screw 72 extends will be referred to as the fastening part P3 of the frame 40.

Height positions of the connection parts P1, P2 and the fastening part P3 are respectively denoted by H1, H2, and H3. A height position of the horizontal upper faces 58*a* of the base plates 58 (i.e., a height position of the mounting parts 58*p*1 thereon) is denoted by H4. The rear end portion (i.e., the mass portion 32) of each hammer 30 is moved upward in a key-depression forward stroke and takes its uppermost position in a pivot end state. In FIG. 2, the uppermost height position of the hammer 30 is denoted by H5, and a lowermost height position of the common-to-all-keys base end KT (i.e., a height position of a lowermost edge thereof) is denoted by H6.

In the following, a positional relation between various parts of the keyboard apparatus is described in detail. A rearmost end 32*p*1 of each hammer 30 is always positioned on the rearmost side during the entire pivotal motion process of the hammer 30. As shown in FIG. 1, the rearmost end 32*p*1 of the hammer (i.e., the rearmost position thereof) is located forward of the rearmost position 26*p*1 of the visible part of the corresponding black key 20, and the corresponding hammer pivot shaft 43 is located rearward of the frontmost position 26*p*2 of the visible part of the black key 20. The rear extension 30*r* of the hammer 30 has its length less than the distance between the vertical planes X1 and X2, and is thus made compact.

Since the distance between the engagement recess 31 (or hammer pivot shaft 43) and the rearmost end 32*p*1 of each hammer 30 is short, a vertical stroke range of the rearmost ends 32*p*1 of the hammers 30 becomes narrow, making it easy to configure the keyboard apparatus compact in vertical size.

As shown in FIG. 2, the plate portion 54 is located forward of the rearmost position 26*p*1 of the visible parts of the black keys 20 and upward of the height position H3 of the fastening part P3, whereby a pivotal motion range of the hammers 30 can be ensured within a limited space at forward of the common-to-all-keys base end KT. Since the key switches 59 are disposed upward of the plate portion 54, these switches do not affect the pivotal motion range of the hammers 30 and it is unnecessary to unduly increase the vertical size of the keyboard apparatus.

The lowermost part 59*p*1 of each of the key switches 59 on the base plates 58 is at the height position H4, which is between the height position H1 of the connection parts P1 where the key bodies 16, 17 are connected with the hinges 17, 27 and the height position H2 of the connection parts P2 where the hinges 17, 27 are connected with the common base ends 18A, 18B, 28. Thus, the lowermost parts 59*p*1 of the key switches 59 are positioned above the connection parts P2 and the fastening part P3, whereby a large space can be ensured below the key switches 59 and the pivotal motion range of the hammers 30 can be ensured with ease.

As shown in FIG. 2, the plate portion 54 to which the end stopper 55 is mounted is located between the connection parts P1 and the fastening part P3 (height positions H1 and H3) as viewed in the vertical direction, and more specifically, is located at a height position substantially the same as the height position H2 of the connection parts P2. Since the plate portion 54 of the frame 40 obliquely extends forwardly and downwardly, the plate portion 54 assumes its uppermost position at the rearmost end 54*p*1 of its upper surface and assumes its lowermost position at the frontmost end 54*p*2 of its lower surface. A mounting part 54*p*3 of the plate portion 54, to which the end stopper 55 is mounted, is at a height position substantially the same as the height position H2 of the connection parts P2. In other words, the height position H2 of the connection parts P2 is between the uppermost position 54*p*1 and the lowermost position 54*p*2 of the plate portion 54.

With the above arrangement, the height size of the frame 40 can be suppressed while ensuring a pivotal motion range of the hammers 30 and an appropriate thickness of the end stopper 55. Furthermore, a space for installation of the key switches 59 can be ensured at a location above the plate portion 54, and an appropriate thickness of the key switches 59 can be ensured with ease. The end stopper 55 is disposed below the plate portion 54, whereas the key switches 59 are disposed on the base plates 58 located above the plate portion 54. Thus, the plate portion 54 is disposed below the key switches 59. As a result, the key switches 59 and the plate portion 54 can concentratedly be disposed at a rear part of the keyboard apparatus, making it possible to enhance the component arrangement efficiency and make the keyboard apparatus compact.

The lowermost position H6 of the common-to-all-keys base end KT is lower than the uppermost position H5 (see FIG. 2) of the hammers in the pivot end positions. This makes it easy to configure the common-to-all-keys base end KT so as to extend in the vertical direction. Indeed, the base end KT is configured to vertically extend in this embodiment. As a result, the entire length of each of the keys 10, 20 becomes short, and it is therefore easy to make the keyboard apparatus longitudinally compact.

Since the hinges 17, 27 are configured to extend vertically, when any of the keys 10, 20 is depressed, an upper portion of the corresponding hinge 17 or 27 is flexed forwardly as disclosed in Japanese Laid-open Patent Publication No. 2008-26403. As a result, the flexure of the hinge 17 or 27 acts to cancel a rearward displacement of a key-depression point on the key-depression surface of the depressed key due to a pivotal motion of the depressed key about the common-to-all-keys base end KT. Thus, a substantial locus of the key-depression point is made close to a locus of a key-depression point of an acoustic grand piano key, which is long in length and adapted to pivot about a fulcrum provided below the key. Accordingly, proper loci of the key depression surfaces 16*a*, 26*a* can be attained, which contributes to improvement in expression.

Since the key-guide coupling portion 49 and the plate portion 54, i.e., plural ones among the above-described function-part mounting portions, are concentratedly disposed in the vertical direction between the connection parts P1 and the fastening part P3 (between the height positions H1 and H3), which are located at an upper part of the frame 40, a pivotal motion range of the hammers 30 can easily be ensured and the height size of the frame 40 can be suppressed. It should be noted that from this viewpoint, function-part mounting portions other than the key-guide coupling portion 49 and the plate portion 54 can also be disposed between the height positions H1 and H3.

As described above, the frame 40 is in contact with the keybed 19 only at the front-side and rear-side supporting portions 41, 45 which are contact portions of the frame 40, and all the frame function parts except the contact portions and the hammer pivot shafts 43 are concentratedly disposed in an upper part of the frame 40 located above the lowermost position H6 of the common-to-all-keys base end KT, whereby a pivotal motion range of the hammers 30 can easily be ensured and the height size of the frame 40 can be suppressed.

With this embodiment, the pivotal motion range of the hammers 30 can be ensured within a limited space, and at the same time the entire keyboard apparatus can be made longitudinally compact.

Specifically, the hinges 17, 27 of the key unit UNT are arranged to extend perpendicularly to the key depression surfaces 16*a*, 26*a* of the keys 10, 20 and parallel to the vertical direction and the key arrangement direction, and therefore the longitudinal distance between the tip end of each key 10 or 20 and the corresponding connection part P2 can be shortened, whereby longitudinal sizes of the keys 10, 20 can be reduced and a depth size of the keyboard apparatus can be suppressed. Since the rear extension 30*r* of each hammer 30 has a length less than the distance between the rearmost and frontmost positions 26*p*1, 26*p*2 of the visible part of the corresponding black key 20, the longitudinal length of the hammer 30 can be suppressed.

Since the plate portion 54 is positioned forward of the rearmost position 26*p*1 of the visible part of the black key 20 and upward of the fastening part P3, a pivotal motion range of the hammers 30 can be ensured within a limited space at frontward of the common-to-all-keys base end KT.

Since the initial stopper 48 and the end stopper 55 are respectively disposed on the front and rear sides of the hammer pivot shafts 43 so as to be apart from each other in the longitudinal direction, a pivotal motion range of the hammers 30 can easily be ensured. Moreover, since the stopper mounting portion 47 and the plate portion 54 to which the initial stopper 48 and the end stopper 55 are respectively mounted do not overlap each other in longitudinal position, it is unnecessary for these portions 47, 54 to be intentionally displaced in longitudinal position from each other to realize easy integral formation of the frame 40, whereby the depth size of the frame 40 can be prevented from increasing and the longitudinal length of the frame 40 can be reduced.

It should be noted that in the embodiment the hinges 17, 27 are vertically extended as seen from side, however, only from the viewpoint of suppressing the depth size of the keyboard apparatus and attaining satisfactory moving loci of the key-depression surfaces 16*a*, 26*a*, the hinges 17, 27 can be so arranged as to extend in a direction to cross the key-depression surfaces 16*a*, 26*a* at an angle as close to right angles as possible.

It should be noted that in the embodiment the keys 10, 20 are configured into the key unit, however, the present invention is also applicable to a keyboard apparatus where the keys 10, 20 are arranged individually from one another.

It should be noted that in the embodiment, each hammer 30 is formed with the engagement recess 31 and the frame 40 has the hammer pivot shafts 43, however, each hammer can be formed with a shaft portion and the frame 40 can be formed with engagement recesses, so that the male-to-female connection of the hammer and the frame is reversed from that in the embodiment.

Figure 3:
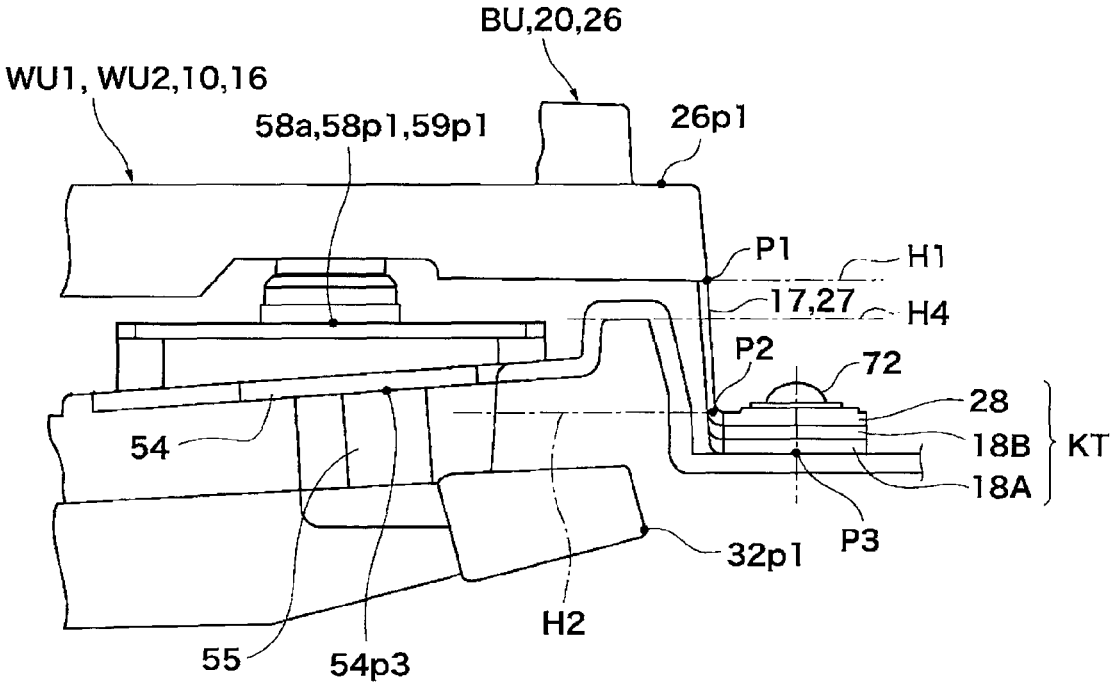
FIG. 3 is a fragmentary side view showing a modification of a rear half of the keyboard apparatus.

It should be noted that the common-to-all-keys base end KT can be configured not to extend vertically but extend horizontally as in a modification shown in FIG. 3 although such an arrangement is not suitable to reduce the longitudinal length of the frame 40.

What is claimed is:

1. A keyboard apparatus comprising:

a frame having hammer supports and integrally formed by resin, said frame being adapted to be supported on a musical instrument main body;

a plurality of white and black keys mutually juxtaposed on said frame and forming one key unit by having key main bodies thereof each connected to its base end via a thin plate-like hinge, each of the key main bodies being pivotable about the base end as a key fulcrum in key depression and release directions;

a plurality of hammers mutually juxtaposed so as to correspond to respective ones of said keys and supported by the hammer supports of said frame at locations below respective ones of said keys so as to each pivot about a corresponding one of the hammer supports in conjunction with the corresponding key and impart inertia to a pivotal motion of the key, each of said hammers being driven at its front half located forward of the hammer support such that a rear end portion of the hammer is moved upward in a key-depression forward stroke;

detection, devices each adapted to be depressed by a corresponding one of said keys and detect an operation of the key; and detection-device mounting portions integrally formed on said frame and respectively mounted with said detection devices, wherein said keys are mounted to said frame by being fastened to a fastening part of said frame by a fastener, with the base ends of said keys stacked one upon another, the hinges of said keys are formed to extend in a direction to cross key depression surfaces of the key main bodies and parallel to a key arrangement direction, said hammers have their rear ends located forward of rearmost positions of visible parts of said black keys, the visible parts being visible during performance, the hammer supports are located rearward of frontmost positions of the visible parts of said black keys, and said detection-device mounting portions are located forward of the rearmost positions of the visible parts of said black keys and upward of the fastening part of said frame.

2. The keyboard apparatus according to claim 1, wherein said detection devices have their lowermost parts positioned in a vertical direction between the fastening part of said frame and connection parts where the key main bodies of said keys are connected with the hinges.

3. The keyboard apparatus according to claim 1, wherein said detection devices have their lowermost parts positioned upward of connection parts where the base ends of said keys are connected with the hinges.

4. The keyboard apparatus according to claim 3, wherein said detection devices have their lowermost parts positioned in a vertical direction between connection parts where the key main bodies of said keys are connected with the hinges and connection parts where the base ends of said keys are connected with the hinges.

5. The keyboard apparatus according to claim 1, including:

an end stopper disposed rearward of the hammer supports and formed on said frame integrally therewith or separately therefrom, said end stopper being adapted for contact with rear halves of said hammers to thereby restrict pivot end positions of said hammers corresponding to key-depression end positions; and an end-stopper mounting portion integrally formed on said frame and mounted with said end stopper, wherein said end-stopper mounting portion is disposed in a vertical direction between the fastening part of said frame and connection parts where the key main bodies of said keys are connected with the hinges.

6. The keyboard apparatus according to claim 5, wherein said end-stopper mounting portion is disposed at substantially a same height position as that of connection parts where the base ends of said keys are connected with the hinges.

7. The keyboard apparatus according to claim 5, wherein said end-stopper mounting portion is positioned below said detection devices.

8. The keyboard apparatus according to claim 1, wherein lowermost positions of the base ends of said keys are located below uppermost positions of the rear end portions of said hammers which are at pivot end positions.

9. The keyboard apparatus according to claim 1, including:

a plurality of frame function parts formed on said the frame integrally therewith or separately therefrom, each of said frame function parts being adapted for contact and engagement with a corresponding one of constituent elements of the keyboard apparatus other than said frame when the keyboard apparatus is in use; and a plurality of function-part mounting portions integrally formed on said frame and respectively mounted with said frame function parts, each of said function-part mounting portions being adapted to receive an external force via a corresponding one of said frame function parts, wherein plural ones among said function-part mounting portions are disposed in a vertical direction between the fastening part of said frame and connection parts where the key main bodies of said keys are connected with the hinges.

10. The keyboard apparatus according to claim 9, wherein said frame function parts include the hammer supports and a contact portion, said contact portion being integrally formed on said frame and adapted to be in contact with the musical instrument main body to thereby support said frame on the musical instrument main body, and all the frame function parts except the contact portion and the hammer supports are disposed upward of lowermost positions of the base ends of said keys.

11. A keyboard apparatus comprising:

a frame having hammer supports and integrally formed by resin, said frame being adapted to be supported on a musical instrument main body;

a plurality of white and black keys mutually juxtaposed on said frame and having key main bodies thereof each connected to its base end via a thin plate-like hinge for pivotal motion about the base end as a key fulcrum in key depression and release directions;

a plurality of hammers mutually juxtaposed so as to correspond to respective ones of said keys and supported by the hammer supports of said frame at locations below respective ones of said keys so as to each pivot about a corresponding one of the hammer supports in conjunction with the corresponding key and impart inertia to a pivotal motion of the key, each of said hammers being driven at its front half located forward of the hammer support such that a rear end portion of the hammer is moved upward in a key-depression forward stroke;

an initial stopper disposed forward of the hammer supports and formed on said frame integrally therewith or separately therefrom, said initial stopper being adapted for contact with the front halves of said hammers to thereby restrict initial pivot positions of said hammers corresponding to key-depression initial positions; and an end stopper disposed rearward of the hammer supports and formed on said frame integrally therewith or separately therefrom, said end stopper being adapted for contact with the rear end portions of said hammers to thereby restrict pivot end positions of said hammers corresponding to key-depression end positions, wherein said keys are mounted to said frame by being fastened to a fastening part of said frame by a fastener, with the base ends of said keys stacked one upon another, the hinges are formed to extend in a direction to cross key depression surfaces of the key main bodies and parallel to a key arrangement direction, said hammers have their rear ends located forward of rearmost positions of visible parts of said black keys, the visible parts being visible during performance, and the hammer supports are located rearward of frontmost positions of the visible parts of said black keys.

12. The keyboard apparatus according to claim 11, wherein lowermost positions of the base ends of said keys are located below uppermost positions of the rear end portions of said hammers which are at pivot end positions.

* * * * *